US006517035B1

(12) United States Patent
Sellers

(10) Patent No.: US 6,517,035 B1
(45) Date of Patent: Feb. 11, 2003

(54) ELEVATED POTTED PLANT SAUCER TABLE

(76) Inventor: Kathleen R. Sellers, 3594 S. Ocean Blvd., #301, Highland Beach, FL (US) 33487

( * ) Notice: Subject to any disclaimer, the term of this patent is extended or adjusted under 35 U.S.C. 154(b) by 0 days.

(21) Appl. No.: 09/975,000

(22) Filed: Oct. 11, 2001

(51) Int. Cl.[7] ..... A47G 23/02

(52) U.S. Cl. ..... 248/146; 248/175; 248/153; 47/39

(58) Field of Search ..... 248/146, 153, 248/27.8, 175, 97; 47/39

(56) References Cited

U.S. PATENT DOCUMENTS 500,006 A * 6/1893 Stocker et al.
933,142 A * 9/1909 Vogt ..... 211/181.1
936,619 A * 10/1909 fFoy ..... 211/74
983,473 A * 2/1911 Barnes ..... 220/23.87
1,688,846 A * 10/1928 Andrews ..... 210/250
2,573,372 A * 10/1951 Wagler ..... 248/153
2,791,391 A * 5/1957 Uphoff ..... 248/150
4,534,130 A 8/1985 Rogers
4,674,415 A 6/1987 Smith
4,834,335 A * 5/1989 Attar ..... 248/526
4,875,649 A 10/1989 Bendig, Jr.
4,914,857 A * 4/1990 Dodgen ..... 248/156
D384,222 S 9/1997 Cheng
6,119,393 A * 9/2000 Wourms et al. ..... 248/175

* cited by examiner

*Primary Examiner*—Kimberly Wood
(74) *Attorney, Agent, or Firm*—Malin, Haley & DiMaggio. P.A.

(57) ABSTRACT

An elevated, transportable, potted plant support comprising at least three vertical legs each having a foot with minimal floor surface contact area, each leg being affixed at the upper end to two substantially parallel horizontally disposed rings spacedly situated one above the other, the lower ring having a bottom planar support surface extending to the perimeter which accommodates a mechanically engaged (manually) removeable saucer for holding a potted plant and preventing draining water from escaping.

3 Claims, 4 Drawing Sheets

ELEVATED POTTED PLANT SAUCER TABLE

BACKGROUND OF THE INVENTION

1. Field of the Invention

This invention relates generally to support stands such as may be used for supporting and displaying a potted plant elevated above the underlying floor surface and more specifically to a stable, rigid, aesthetically pleasing, easily transportable potted plant support table which incorporates a snapably removable saucer, to support one or more potted plants above the ground closer to eye level, able to retain water and debris and configured with floor-foot contact points of reduced area so as to minimize damage to the floor surface.

2. Description of Related Art

While the present invention can be used to support almost any item having a size, shape and weight within a preselected range, the invention is particularly suited for supporting potted plants. Displaying potted plants is a popular, simple and inexpensive way to decorate and beautify an environment such as the home, the office and the like. While it is possible and often done, potted plants can simply be placed on a floor, carpet or patio surface, however, such placement can stain, crush carpet or otherwise damage the underlying surface. Potted plants require watering. Most plants require that excess water be allowed to escape from the pot containing the plant otherwise the roots of the plant may become rotten causing the plant to die. Excess water allowed to escape from potted plants often stains and damages the carpet or other surface supporting the pot when not adequately contained.

Additionally, it is frequently desirable to elevate a potted plant well above the underlying supporting floor surface utilizing an easily transportable device that integrally supports the potted plant. Such a support ideally would retain drained/leaking excess water and debris from the pot, be sized as to be unobtrusive, be aesthetically designed allowing group arrangements to maximize the beauty of the plant and the room decor by bringing the plant closer to the eye, be transportable for decorative purposes and minimize water damage to floor surfaces and coverings. Furthermore, it is sometimes necessary to raise the level of a potted plant to increase the likelihood of sufficient levels of sunlight reaching the plant to assure that the plant will survive and thrive in the particular selected environment.

A variety of plant stands and drip pans within the art seek to address one or more of the concerns described above.

U.S. Pat. No. 4,534,130 to Rogers is directed to a wire mesh basket for carrying and displaying potted plants having wire handles. The wire handles may be used as legs for supporting the basket above the floor surface for displaying plants.

U.S. Pat. No. 4,674,415 to Smith discloses a plant stand comprised of a plurality of rod members in detachable combination with a pair of sleeves and locking rings and having an upper portion outwardly bent to accommodate the supporting structure such as a plant pan or table top and lower portion bent outwardly to act as support legs.

U.S. Pat. No. 4,875,649 to Bendig, Jr. is directed to an elevated, rigid, bent-wire support stand having four legs and a spider-like configuration for support of a potted plant.

U.S. Design Pat. No. D384,222 to Cheng discloses an ornamental plant stand consisting of four arced vertically positioned members terminating in circular members at each end.

U.S. Design Pat. No. D397,261 to Sellers is directed to the ornamental-design for a plant saucer support stand having three curved, vertically positioned members connected together in the center by a circular or oval ring member.

U.S. Design Pat. No. D411,058 to Sellers discloses an ornamental design for a plant caddy with built-in saucer.

Unfortunately none of these related devices adequately satisfies the need for an aesthetically pleasing, elevated, transportable, easily grouped plant support integrally housing an unobtrusive, fluid retaining drip saucer capable of supporting a potted plant therein and which minimizes damage to the underlying floor surface and coverings.

BRIEF SUMMARY OF THE INVENTION

An elevated support structure for potted plants formed of at least three rigid, substantially vertical legs each joined at its upper end to upper and lower ring-shaped rod members, both ring-shaped members disposed, with the upper ring-shaped rod member above the lower ring-shaped rod member. Interconnected central rod members are affixed within and across the planar circumferential perimeter of the lower ring shaped member forming a rigid planar support surface substantially parallel to the floor support surface on which one or more potted plants can be supported.

A waterproof, light-weight, sturdy, and slightly flexible saucer (drip tray) having a flat, leak resistant planar bottom surface and upwardly projecting sides fits snug within the area formed by the two ring-shaped members affixed to the legs and rests atop the horizontal interconnected central members and can lock or manually be "snapped" into removeable engagement. The bottom surface of the saucer is positioned in substantial parallel arrangement to and elevated above the floor by the legs of the support stand to accommodate a potted plant, thereby preventing the bottom of the potted plant or fluid leakage therefrom from staining or damaging the underlying surface (e.g. carpet, floor) upon which the support structure rests.

The upwardly projecting side(s) of the saucer terminate in a notched circumferential lip which snaps into place beneath the upper ring shaped rod member while the bottom surface of the saucer rests flush against the interconnected central members extending in horizontal planar fashion across the bottom of the lower ring-shaped member. The notched lip allows the saucer to fit securely within the area defined by the two ring-shaped members so that the saucer does not lift out of the support stand when the potted plant is removed in the event that the pot and plant have adhered to the saucer due to water contained therein creating a suction or adherence of the pot to the saucer.

In the preferred embodiment, the present invention provides at least three legs, each leg terminating in a foot having a minimal contact point of less than two square centimeters with the floor so as to reduce the size of the contact area and the possibility of staining, wear and tear, carpet crushing and other damage to the underlying surface.

The present invention can be constructed of any durable, sturdy material capable of supporting the weight of one or more potted plants, such as iron, wood, aluminum, steel, polymers, resins, and plastics, but preferably steel. The saucer is preferably constructed of any waterproof, light-weight slightly flexible material, such as polycarbonate. The legs and feet may be optionally configured, e.g. curved, angled, decoratively carved or shaped as to enhance the aesthetic appearance of the invention and to minimize contact point area with the underlying floor surface.

In accordance with these and other objects which will become apparent hereinafter, the instant invention will now be described with particular reference to the accompanying drawings.

DETAILED DESCRIPTION OF THE INVENTION

Figure 1:
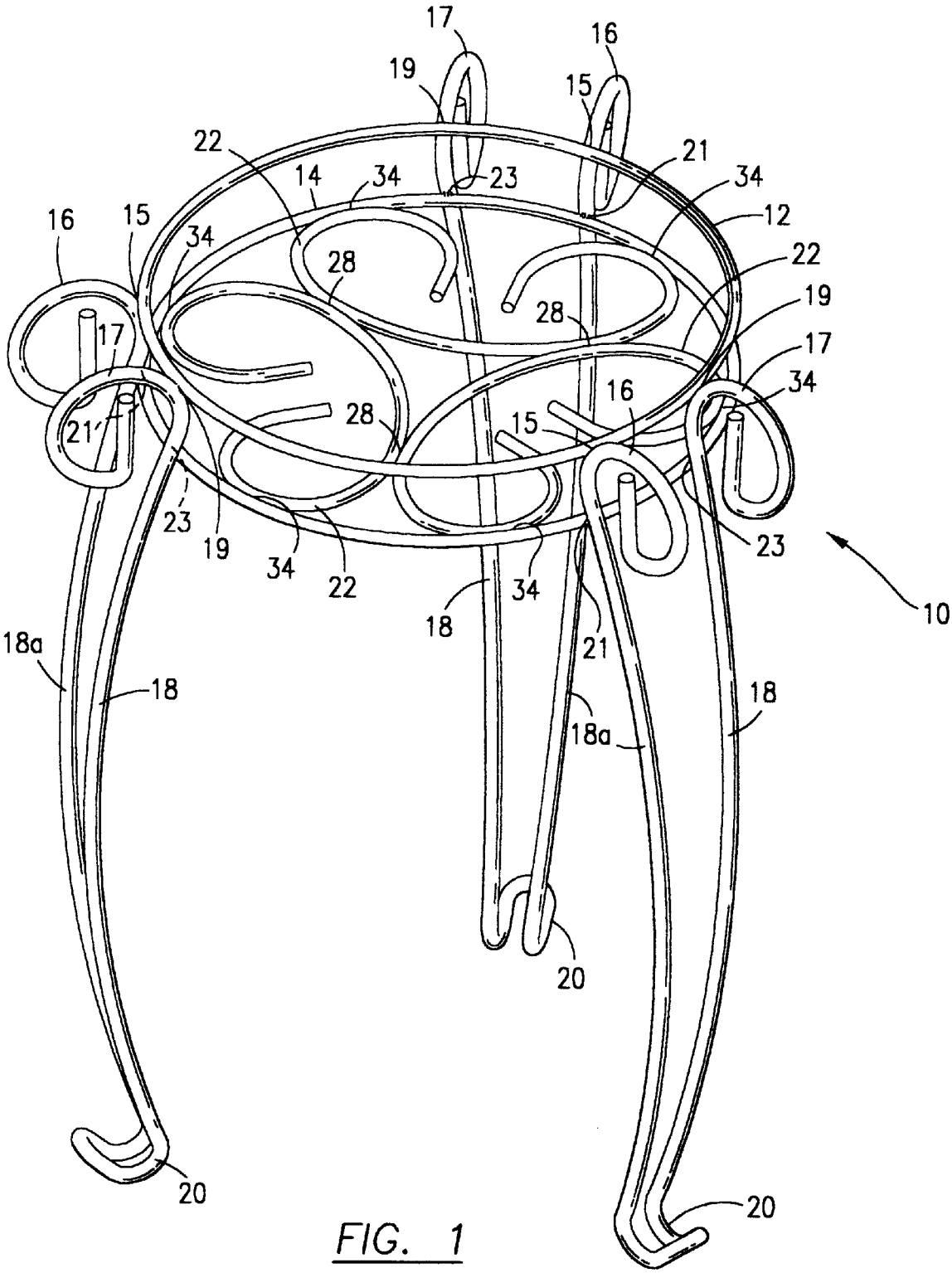
FIG. 1 is a perspective view of the present invention.
Figure 2:
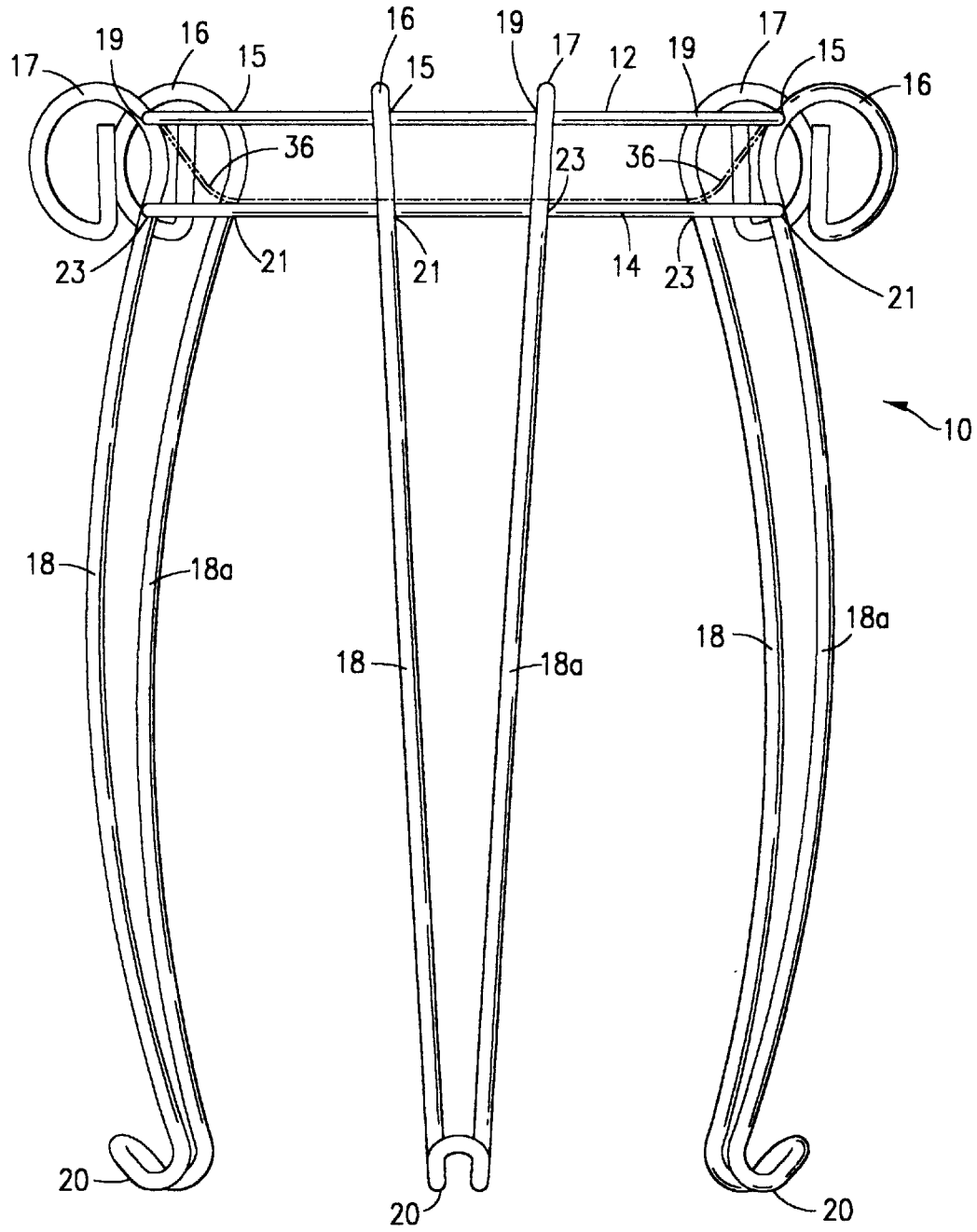
FIG. 2 is a side elevation view of the present invention with the plant saucer insert shown in phantom.

Referring now to FIGS. 1 and 2, the present invention is shown generally at 10 comprising at least three substantially vertical legs formed by leg rods 18 and 18*a* affixed to an upper ring-shaped rod member 12 at joints 15 and 19, and to lower ring-shaped rod member 14 at joints 21 and 23.

Figure 3:
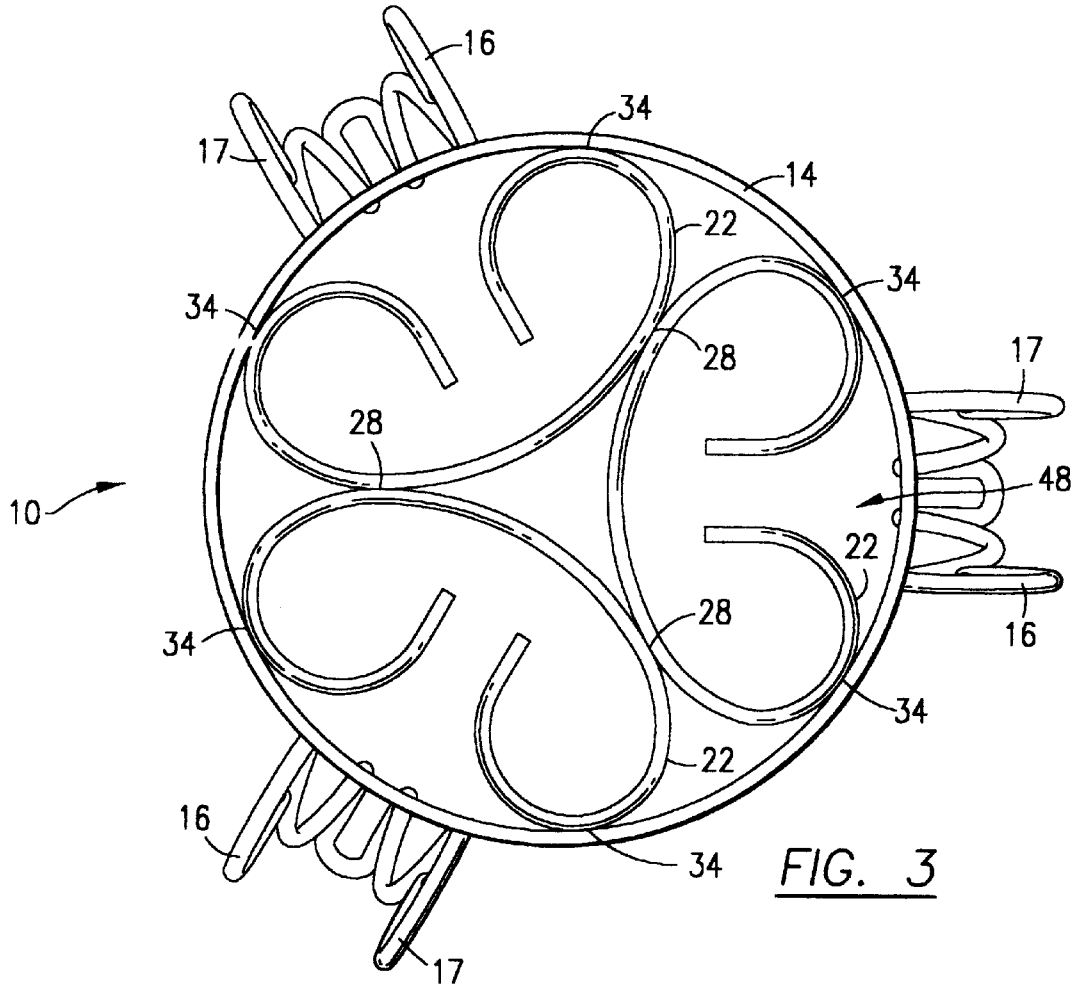
FIG. 3 is a top plan view of the present invention.
Figure 4:
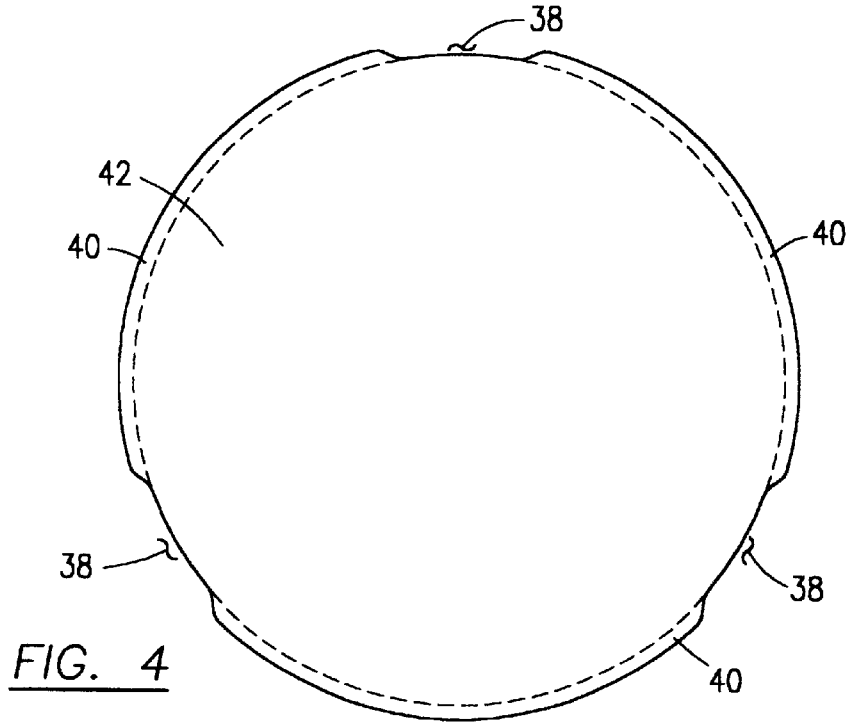
FIG. 4 is a top plan view of the snap in saucer removed for clarity.
Figure 5:
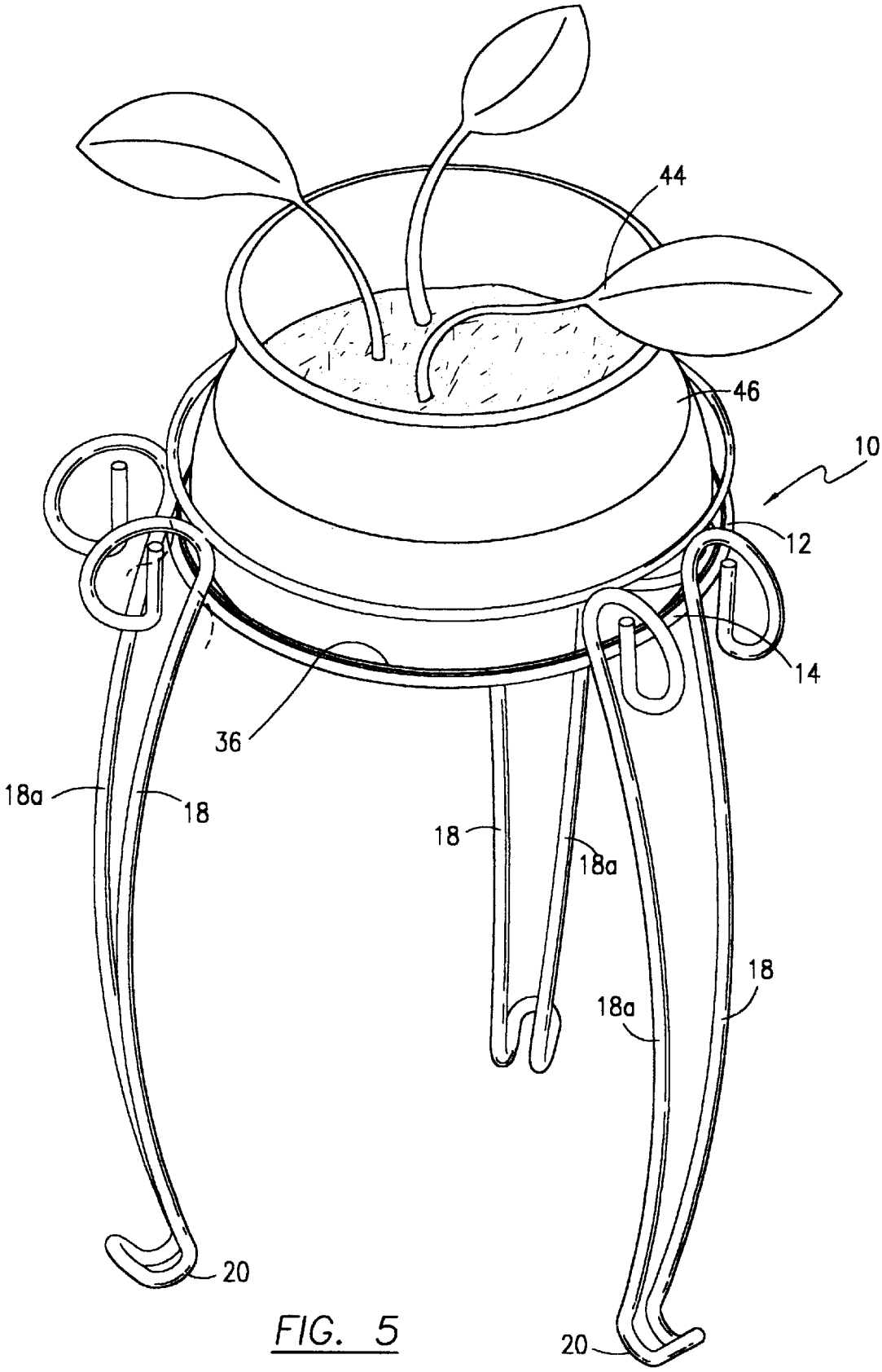
FIG. 5 is a perspective view of the present invention in use holding a potted plant within the removable saucer.

In FIG. 3 central members 22 are shown joined to lower ring-shaped rod member 14 at joint 34 and to each other at joints 28 to form a rigid bottom planar support surface 48 to accommodate the saucer 36 (shown in FIG. 4) into which one or more plant(s) 44 in a pot 46 (as shown in FIG. 5) is placed.

The joints 15, 19, 21, 23, 28, and 34 are formed by a bead of welding. Those skilled in the art to which the present invention pertains will understand that a variety of alternative joining processes may be used to form the joints 15, 19, 21, 23, 28, and 34, such as by soldering, metal-gluing or by placing a small rivet or screw.

The vertical depth of the area formed by the rigid bottom planar support surface 48, upper and lower ring-shaped rod members 12 and 14 respectively is in the range of 1 to 8 centimeters which provides a degree of lateral support for the plant pot 46 as it rests upon the support stand. The vertical depth helps to restrain the pot from slipping off the support stand such as what would occur if the potted plant were merely supported on a flat pedestal table and for enhanced overall stability.

In FIG. 4 saucer 36 is shown with notches 38 and lip 40 around the perimeter of the horizontal bottom planar surface 42. The notches coincide with and accommodate for the areas where leg rods 18 and 18*a* join the upper ring-shaped rod member and the lip 40 mechanically engages to fit under the perimeter of the upper ring-shaped rod 14 to reasonably secure the saucer within the support stand. FIG. 3 discloses three legs and FIG. 4 discloses the three corresponding lipped areas 40 which engage mechanically and fit under the perimeter of upper ring-shaped rod 12 along the perimeter length measured between the three legs. FIG. 5 illustrates the position of saucer 36 when properly installed.

The actual dimensions of the plant support stand 10 of the present invention may vary depending upon its particular application. In a preferred embodiment of the invention, the height from the floor to the uppermost points 16 and 17 of leg rods 18 and 18*a* respectively is in the range of 30 to 100 centimeters although such range should not be considered limiting and may change depending upon the application. The overall horizontal width at the widest point of the invention 10 may be in the range of 22 to 55 centimeters although such range should not be considered limiting. The diameter of the ring-shaped rod members 12 and 14 at the widest point may be in the range of 20 to 50 centimeters although such range should not be considered limiting. The shape of rod members 12 and 14 may also be oval, square, free form or any other suitable shape. The reference to being ring-shaped for rod members 18 and 18*a* merely connotes an uninterrupted, continuous connection and is intended to include geometric shapes as well, such as rectangles, triangles, or polygon. The continuous, connected arrangement of ring-shaped rod members 12 and 14 can be created by the joinder of the legs with the ring-shaped members although rod members 12 and 14 were not continuous standing alone and prior to such joinder of the legs to the rod members 12 and 14. The contact point area of each foot is in the range 2 to 8 square centimeters, preferably 2 to 4 square centimeters. However, it will be understood that the various dimensions defined herein may be varied by simply selecting different length members and their bend points and angles and are not deemed to be limiting of the present invention.

The potted plant saucer table (legs, feet, ring-shaped members and central members) can be constructed of virtually any rigid, durable material, e.g., metals including but not limited to steel, aluminum, and iron; rubber; plastics including resins and other polymers, or wood, but preferably steel. Legs, feet, ring-shaped and central members may be solid or hollow, cylindrical rods, bent, angled, carved, or geometrically configured. The saucer can be constructed of any waterproof, lightweight, slightly flexible, moldable material such as plastics of the type typically utilized in the manufacture of plant trays for water leakage under potted plants.

The instant invention has been shown and described herein in what is considered to be the most practical and preferred embodiment. It is recognized, however, that departures may be made therefrom within the scope of the invention and that obvious modifications will occur to a person skilled in the art as a result of the applicant's disclosure herein. Various modifications and additions which may be made to the invention, include those relating to size and shape, materials used and thicknesses for the basic structure. All such modifications and additions are deemed to be within the scope of the invention which is to be limited only by the claims appended hereto.

What is claimed is:

1. A potted plant support comprising:

at least three substantially vertical rigid legs each having an upper end and a lower end terminating in a foot having minimal contact area with the floor surface;

an upper ring-shaped rod member positioned between and fixedly connected to said upper end portions of said vertical rigid legs at intermittent circumferential points about the perimeter of said upper ring-shaped member and in a horizontal planar arrangement relative to said floor surface;

a lower ring-shaped rod member positioned spacedly below and substantially parallel to the horizontal plane of said upper ring-shaped rod member, said lower ring-shaped rod member being fixedly connected to said upper end portions of said vertical rigid legs at intermittent circumferential points about the perimeter of said lower ring-shaped member, said lower ring-shaped rod member forming a substantially horizontal bottom planar surface by the attachment of a center support means to the perimeter of said lower ring-shaped rod member and capable of supporting a potted plant; and a lightweight, waterproof saucer having a planar bottom and upwardly projecting sides terminating in an upper lip notched at intervals and which the lip snapably fits under the perimeter of the upper ring-shaped bent rod member such that said bottom of said saucer is positioned and supported securely atop said bottom of said lower ring-shaped bent rod member in horizontal arrangement relative to the floor surface and capable of supporting a potted plant.

2. The plant support according to claim 1 wherein said legs are curved, bent rods each integrally terminating in an upward-turning curved, bent foot and wherein said legs have height dimensions in the range of 30 to 100 centimeters and are constructed of steel, and wherein said ring-shaped rod members are circular having a diameter in the range of 20 to 50 centimeters and are constructed of steel and wherein said saucer is constructed of plastic.

3. The plant support according to claim 1 wherein said center support means is three central members, said central members attached to each other and said lower ring-shaped rod member forming a planar surface substantially in alignment with the perimeter of said lower ring shaped rod member.

* * * * *